US005220862A

United States Patent [19]

Schexnayder

[11] Patent Number: 5,220,862

[45] Date of Patent: Jun. 22, 1993

[54] FLUID REGENERATION CIRCUIT

[75] Inventor: Lawrence F. Schexnayder, Joliet, Ill.

[73] Assignee: Caterpillar Inc., Peoria, Ill.

[21] Appl. No.: 883,550

[22] Filed: May 15, 1992

[51] Int. Cl.[5] ..... F15B 11/04

[52] U.S. Cl. ..... 91/436; 91/445; 91/459

[58] Field of Search ..... 91/28, 31, 436, 440, 91/444, 445, 459

[56] References Cited

U.S. PATENT DOCUMENTS

| | | | |
|---|---|---|---|
| 2,367,682 | 1/1945 | Kehle | 91/436 |
| 3,906,840 | 9/1975 | Bianchetta et al. | 91/445 |
| 3,984,979 | 10/1976 | Budzich . | |
| 4,194,436 | 3/1980 | Imada | 91/436 |
| 4,610,193 | 9/1986 | Barker et al. | 91/436 |
| 5,046,309 | 9/1991 | Yoshino | 91/436 |
| 5,048,395 | 9/1991 | Ohshima | 91/459 |

*Primary Examiner*—Edward K. Look
*Assistant Examiner*—F. Daniel Lopez
*Attorney, Agent, or Firm*—John W. Grant

[57] ABSTRACT

Fluid regeneration circuits are useful for filling expanding sides of a hydraulic motor with fluid being exhausted from the other side. The components of the currently available regeneration circuits are disposed in or adjacent to the directional control valve such that the fluid used for regeneration must pass through relatively long motor conduits between the control valve and the hydraulic cylinder. The regeneration circuit of the present invention includes a load check valve which forces the fluid exhausted from the head end chamber of a hydraulic motor to pass through a poppet valve controllably opened by a control signal. A low pressure relief valve causes an increase in the fluid pressure of the exhausted fluid passing through the poppet valve such that when the pressure level exceeds the pressure level of the fluid in an expanding side rod end chamber of the hydraulic motor, the exhausted fluid passes through a regeneration check valve and fills the expanding rod end chamber. The components of the regeneration circuit can be mounted directly to the hydraulic motor or in close proximity thereto minimizing the length of conduits through which the fluid must traverse as well as bypassing the directional control valve.

6 Claims, 1 Drawing Sheet

FLUID REGENERATION CIRCUIT

TECHNICAL FIELD

This invention relates to a hydraulic control system and more particularly to a regeneration circuit which uses fluid exhausted from a contracting side of a hydraulic jack to fill the expanding side.

BACKGROUND ART

Some hydraulic control systems employ a regeneration circuit to fill the expanding side of a hydraulic motor with fluid exhausted from the contracting side of the motor. Thus, less fluid is required from the system pump thereby allowing the fluid from the system pump to be used for other work circuits of the system. One such regeneration circuit is disclosed in U.S. Pat. No. 4,028,889.

One of the problems encountered with such regeneration circuit is that some of the components causing regeneration have heretofore been incorporated within the directional control valve while other components are disposed in the return line between the directional control valve and the tank. Locating the regeneration components at such locations drastically reduces the efficiency of the regeneration circuit. For example, the fluid exhausted from the motor must travel the full length of the motor lines between the motor and the directional control valve, pass through the directional control valve in a first direction and then in the reverse direction, and then travel through the full length of other motor lines to the expanding side of the motor. The shape of the passages through the valve body and the flow control element therein restricts fluid flow therethrough thereby generating a pressure drop in the exhausted fluid. An additional pressure drop is generated due to the fluid having to travel through the motor lines which on some vehicles can exceed 7 or 8 meters. The combined effect of the higher pressure drops necessitates the pressure settings of the regeneration circuits to be at a higher level to adequately provide regeneration.

In view of the above, it would be desirable to have a regeneration circuit in which the exhausted fluid bypasses the directional control valve and is located close to the hydraulic motors to minimize the length of the flow path between the contracting and expanding sides of the hydraulic motor. The magnitude of the pressure drop in the exhausted fluid is reduced by bypassing the control valve and shortening the fluid flow path between the retracting and expanding sides of the motors. Minimizing the pressure drop increases the efficiency of filling the expanding side of the motor.

The present invention is directed to overcoming one or more of the problems as set forth above.

DISCLOSURE OF THE INVENTION

In one aspect of the present invention, a fluid regeneration circuit is provided for a hydraulic system having a double acting hydraulic motor which has first and second chambers with the first chamber being subjected to load generated pressure, and first and second conduits connected to the first and second chambers respectively. The regeneration circuit comprises a load check valve disposed in the first conduit to permit fluid flow therethrough in a first direction toward the first actuating chamber and to block reverse fluid flow therethrough. A third conduit is connected to the first conduit on opposite sides of the load check valve to provide a parallel flow path around the load check valve. A remotely controlled poppet valve is disposed in the third conduit to normally block fluid flow through the third conduit in a direction from the first actuating chamber. The poppet valve is controllably movable to an open position by a control signal received thereby. A low pressure relief valve is disposed in the third conduit in series with and downstream of the poppet valve and is oriented to block fluid flow from the first conduit toward the poppet valve. The relief valve is moved to an open position when the fluid pressure in the third conduit between the poppet valve and the relief valve exceeds a predetermined level. A means provides one-way communication of fluid from the third conduit to the second conduit when the fluid pressure in the third conduit between the poppet valve and the relief valve is higher than the fluid pressure in the second conduit.

BRIEF DESCRIPTION OF THE DRAWINGS

The sole FIGURE is a schematic illustration of an embodiment of the present invention.

BEST MODE FOR CARRYING OUT THE INVENTION

Figure 1:
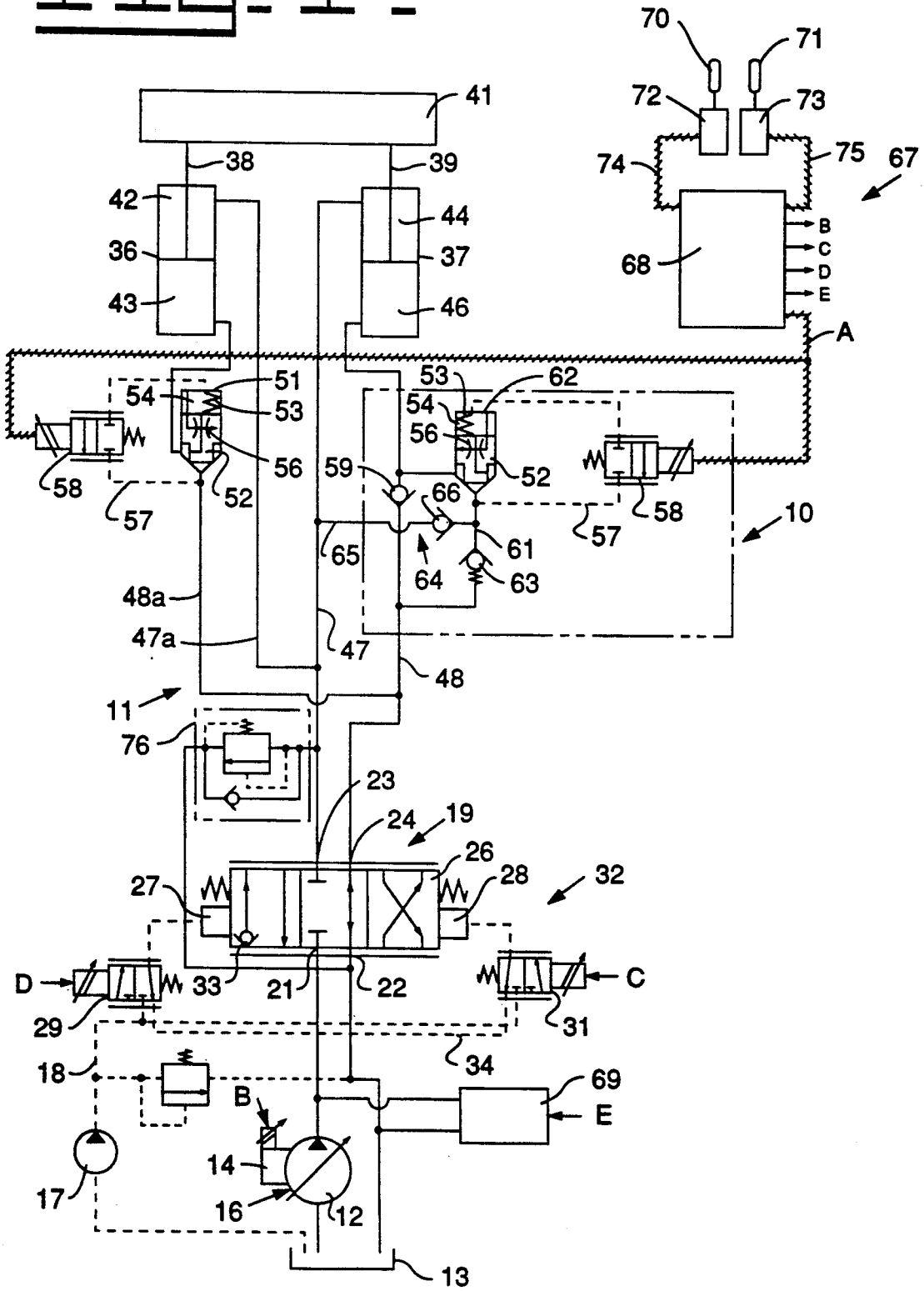

A regeneration circuit 10 is shown as an integral part of a hydraulic system 11. The hydraulic system 11 includes a variable displacement pump 12 connected to a tank 13 and has an electronically controlled displacement controller 14 for controlling the displacement of the pump proportional to a control signal directed thereto. The variable displacement pump 12 constitutes a means 16 for outputting pressurized fluid at a flow rate proportional to a control signal received thereby. A pilot pump 17 is connected to the tank 13 and to a pilot supply line 18.

The hydraulic system 11 also includes a directional control valve 19 having an inlet port 21 connected to the pump 12, a tank port 22 connected to the tank 13, and a pair of motor ports 23,24. The directional control valve 19 also includes a pilot operated elongate valve spool 26, first and second actuating chambers 27,28 disposed at opposite ends of the valve spool 26, and a pair of electrohydraulic proportional valves 29,31 connected to the actuating chambers 27,28 respectively and to the pilot supply line 18. The proportional valves 29,31 constitute a proportional valve means 32 for controlling the position of the valve spool 26 in response to receiving an electrical control signal.

The valve spool 26 is shown at a neutral position at which the motor port 24 communicates with the tank port 22 and the inlet port 21 and the motor port 23 are blocked. The valve spool 26 is movable rightwardly in a first direction at which the inlet port 21 communicates with the motor port 23 through a load check valve 33 while the motor port 24 remains in communication with the tank port 22. The valve spool is movable leftwardly in a second direction to communicate the inlet port 21 with the motor port 24 while the motor port 23 communicates with the tank port 22.

The proportional valves 29,31 are normally spring biased to the position shown at which the actuating chambers 27,28 are in communication with a drain line 34. The proportional valve 29 is movable in a rightward direction to establish communication between the pilot supply line 18 and the actuating chamber 27 in response to receiving an electrical control signal. Similarly, the proportional valve 31 is movable in a leftward direction for establishing communication between the pilot supply line 18 and the actuating chamber 28 in response to receiving an electrical control signal. The fluid pressure established in the respective actuating chambers 27,28 is dependant upon the magnitude of the control signal received by the respective proportional valve. Thus, the extent of the movement of the valve spool 26 in either direction is dependant upon the magnitude of the control signal received by the proportional valves 29,31.

The hydraulic system 11 further includes a pair of double acting hydraulic motors 36,37 which have piston rods 38,39 respectively connected to a common member 41 so that the hydraulic motors 36,37 always move in unison. The hydraulic motor 36 has a rod end chamber 42 and a head end chamber 43. Similarly, the hydraulic motor 37 has a rod end chamber 44 and a head end chamber 46. The member 41 represents a gravity load which generates load induced pressure in the chambers 43 and 46.

A motor conduit 47 connects the motor port 23 with the rod end chamber 44 while another motor conduit 48 connects the motor port 24 with the head end chamber 46. A branch motor conduit **47*a* connects the motor conduit 47 to the rod end chamber 42. Similarly, a branch motor conduit 48*a* connects the motor conduit 48 to the head end chamber 44**.

A remotely controlled flow amplifying poppet type valve 51 is disposed in the branch conduit **48*a* and includes a poppet 52 resiliently urged to a flow blocking position by a spring 53 disposed in a control chamber 54. A variable area flow control orifice 56 is provided in the poppet 52 for continuously communicating the head end chamber 43 with the actuating chamber 54. The orifice 56 increases in size when the poppet 52 moves upwardly. A flow regulating passage 57 connects the control chamber 54 to the branch conduit 48 between the poppet valve and the motor conduit 47. An electro-hydraulic proportional flow regulating valve 58 is disposed in the flow regulating passage 57 and is movable between a closed position blocking communication through the regulating passage and an infinitely variable open position for regulating fluid flow through the regulating passage. The proportional valve 58** is moved to the open regulating position in response to receiving an electrical control signal.

The regeneration circuit 10 includes a load check valve 59 disposed in the motor conduit 48 to permit fluid flow therethrough in a first direction toward the head end chamber 46 and to block reverse fluid flow therethrough. A conduit 61 is connected to the motor conduit 48 on opposite sides of the load check valve 59 to provide a parallel flow path around the load check valve. A remotely controlled flow amplifying poppet type valve 62 is disposed in the conduit 61 to normally block fluid flow through the third conduit in a direction from the head end chamber 46 toward the motor conduit 48. The poppet valve 62 is substantially identical to the poppet valve 51 and reference numerals used to describe the poppet valve 51 are applied to poppet valve 62.

The regeneration circuit 10 also includes a low pressure relief valve 63 disposed in the conduit 61 in series with and downstream of the poppet valve 62. The low pressure relief valve 63 is oriented to block fluid flow from the motor conduit 48 toward the poppet valve 62 and is moved to an open position when the fluid pressure in the conduit 61 between the poppet valve 62 and the relief valve exceeds a predetermined level. A conduit 64 is connected to the conduit 47 and to the conduit 61 between the poppet valve 62 and the relief valve 63. A regeneration check valve 66 is disposed in the conduit 64 to provide one-way communication of fluid therethrough when the fluid pressure in the conduit 61 between the poppet valve and the relief valve is higher than the fluid pressure in the conduit 47.

The hydraulic system 11 includes an electronic control 67 having a microprocessor 68 connected to the proportional valves 58 of the poppet valves 51,62 through an electrical lead line A. Similarly, the microprocessor 68 is connected to the displacement controller 14, and the proportional valves 29,31 through lead lines B, C and D respectively with portions of the lines being omitted for illustrative convenience. The microprocessor 68 is also connected to another work circuit 69 through a plurality of lead lines generally indicated at E. A pair of control levers 70,71 are operatively connected to a pair of operational signal generators 72,73 which are connected to the microprocessor 68 through a pair of electrical lead lines 74,75.

In this embodiment, the poppet valve 51, and the regeneration circuit 10 are mounted in close proximity to the hydraulic motors 36,37. A combined line relief valve and make up valve 76 is connected to the motor conduit 47 and to the tank 13.

INDUSTRIAL APPLICABILITY

In operation, when the control levers 70,71 are in the centered position shown, no command signals are being transmitted through the lead lines 74,75 to the microprocessor 68. When the microprocessor 68 is not receiving a signal through the lead line 74 no control signals are being outputted through any of the lead lines A through E such that the directional control valve 27 is in its neutral position to block the inlet port 21. Under this condition the poppet 52 of the poppet valve 51 blocks fluid flow from exiting the head end chamber 43 while the poppet 52 of the poppet valve 62 and the load check 59 combine to block fluid flow from exiting the head end chamber 46. Moreover, when no command signal is being received by the displacement controller 17, the displacement of the pump 12 in this embodiment is reduced to a position to maintain a low stand-by pressure at the inlet port 21.

To extend the hydraulic motors 36,37, to raise the member 41, the operator moves the control lever 70 clockwise an amount corresponding to the speed at which he wants the motors to extend. In so doing the operational signal generator 72 senses the operational position of the lever 70 and outputs a command signal through the lead line 74 to the microprocessor 68. The microprocessor 68 processes the command signal in accordance with preprogrammed criteria and produces first and second discrete control signals. The first control signal is directed through the lead line C to the proportional valve 31 causing it to move leftwardly to direct pilot fluid from the supply line 18 to the actuating chamber 28. The pressurized pilot fluid in the actuating chamber 28 moves the spool 26 leftwardly to connect the inlet port 21 with the motor port 24 and the motor port 23 with the tank port 22. The extent of rightward movement of the spool 26 is commensurate with the first control signal transmitted through the lead line C. Under this operational condition the spool 26 is moved sufficiently to direct fluid from the pump 12 through the directional control valve 19 at a first predetermined pressure drop.

The second control signal is transmitted through the lead line B to the displacement controller 14 causing the pump displacement to increase to a level to provide a flow rate to achieve the desired operating speed of the hydraulic motors 36,37. The fluid from the pump passes through the directional control valve 19 and unseats the poppet 52 of the poppet valve 51 and the load check 59 allowing the fluid to pass substantially unrestricted therethrough to the head end chambers 43 and 46. The relief valve 63 prevents reverse flow therethrough from the conduit 48 into the conduit 61 between the relief valve and the poppet valve 62. The fluid exhausted from the rod end chambers 42,44 passes through the conduits 47*a*, 47, and through the directional control valve 19 to the tank 13.

Retracting the hydraulic motors 36,37 is accomplished in a similar manner by moving the control lever 70 counter-clockwise so that a command signal is outputted through the lead line 74 to the microprocessor. The microprocessor processes the command signal and produces first, second and third discrete control signals. The first control signal is directed through the lead line D to the proportional valve 29 of the directional control valve 19 causing it to move rightwardly to direct pilot fluid from the supply line 22 to the actuating chamber 27. The second control signal is transmitted through the lead line B to the displacement controller 17 while the third control signal is transmitted through the lead line A to the proportional control valves 58 of the poppet valves 51 and 62 causing them to move in the appropriate direction to establish a flow path through the regulating passages 57. The fluid flow rates through the regulating passages determine the degree of opening of the poppets 52 and is proportional to the third control signal being transmitted to the proportional valves 58. In this embodiment the magnitude of the third control signal can be selected in some operations to cause the poppets 52 to move to a position to generate a second predetermined pressure drop thereacross to slightly restrict the flow of fluid being exhausted from the head end chambers 43,46. Restricting the fluid flow in this manner permits the retraction speed of the hydraulic motors to be substantially controlled by the displacement setting of the pump regardless of whether the retraction is caused solely by the incoming fluid to the rod end chambers 42,44 or by the gravity load of member 41 generating a load induced pressure in the chambers 43,46. In another operational mode, the third control signal may be selected to cause the poppets to fully open to permit substantially unrestricted fluid flow therethrough.

The regeneration circuit 10 functions in the following manner when the hydraulic cylinders 36,37 are being retracted and a load induced pressure exists in the head end chambers 43,46. The load check valve 59 prevents the fluid exhausted from the head end chamber 46 from passing therethrough forcing it to go through the open poppet valve 62 and into the conduit 61. The relief valve 63 initially blocks fluid flow through the conduit 61 to the conduit 48 and causes the pressure in the conduit 61 to increase. If the pressure level in the conduit 61 downstream of the poppet valve 62 becomes higher than the pressure level of the fluid in the conduit 47, the exhausted fluid will pass through the regeneration check valve 66 into the conduit 47. A portion of the fluid entering the conduit 47 will be used to fill the expanding rod end chamber 44 and a portion will pass through the branch conduit 47*a* to fill the expanding rod end chamber 42. If the pressure level in the conduit 61 exceeds the pressure setting of the relief valve 63, then the relief valve opens permitting the remainder of the exhausted fluid to return to the tank 13.

One factor influencing the distribution of the exhausted fluid is the size relationship of the head end chambers 43 and 46 and the rod end chamber 42 and 44. In the present embodiment, the size relationship is 2 to 1. Thus, the volume of fluid exhausted from the head end 46 can fully fill both expanding rod end chambers 42 and 44. However, it is contemplated that in most operating conditions at least some fluid will be directed into the conduit 47 from the pump 12 so that an immediate downward force can be exerted by the hydraulic motors 36,37 when the member 41 encounters any resistance to downward movement. In that situation, the amount of fluid passing through the relief valve 63 will be substantially equivalent to the amount of fluid entering the conduit 47 from the pump 12.

In view of the above it is readily apparent that the structure of the present invention provides a fluid regeneration circuit having improved efficiency. The components of the regeneration circuit can be mounted directly to or in close proximity to the hydraulic motor to minimize line losses or pressure drops associated with having the fluid travel through long lines or conduits connecting the directional control valve to the motor. Moreover, mounting the regeneration components at that location lets the exhausted fluid go directly to the expanding side of the motors and bypasses the directional control valve which would generate an additional pressure drop in the regeneration fluid. Minimizing the pressure drops increases the efficiency since less pressure is required to cause regeneration.

Other aspects, objects and advantages of this invention can be obtained from a study of the drawings, the disclosure and the appended claims.

I claim:

1. A fluid regeneration circuit for a hydraulic system having a double-acting hydraulic motor which has first and second chambers with the first chamber being subjected to load induced pressure, and first and second conduits connected to the first and second actuating chambers respectively comprising:

a load check valve disposed in the first conduit to permit fluid flow therethrough in a first direction toward the first chamber and to block reverse fluid flow therethrough;

a third conduit connected to the first conduit on opposite sides of the load check valve to provide a parallel flow path around the load check valve;

a remotely controlled poppet valve disposed in the third conduit to normally block fluid flow through the third conduit in a direction from the first chamber and being controllably moveable to an open position by a control signal received thereby;

a low pressure relief valve disposed in the third conduit in series with and downstream of the poppet valve and being oriented to block fluid flow from the first conduit toward the poppet valve, the relief valve being moved to an open position when the fluid pressure in the third conduit between the poppet valve and the relief valve exceeds a predetermined level; and means for providing one-way communication of fluid from the third conduit to the second conduit when the fluid pressure in the third conduit between the poppet valve and the relief valve is higher than the fluid pressure in the second conduit.

2. The fluid regeneration circuit of claim 1 wherein the providing means includes a fourth conduit connected to the second conduit and to the third conduit between the poppet valve and the relief valve and a regeneration check valve disposed in the fourth conduit to provide one-way communication of fluid in a direction from the third conduit to the second conduit.

3. The fluid regeneration circuit of claim 2 wherein the first chamber is a head end chamber and the second chamber is a rod end chamber.

4. The fluid regeneration circuit of claim 3 wherein the hydraulic system includes a pump, a tank, and a directional control valve for controlling fluid flow between the pump and the hydraulic motor and between the hydraulic motor and the tank.

5. The fluid regeneration circuit of claim 4 wherein the hydraulic system includes another double acting hydraulic motor having a rod end chamber connected to the second conduit and a head end chamber connected to the first conduit between the directional control valve and the load check valve.

6. The fluid regeneration circuit of claim 5 wherein the directional control valve is a spool type control valve having an inlet port connected to the pump, a tank port connected to the tank, a first motor port connected to the first conduit and a second motor port connected to the second conduit, and an elongated valve spool, the control valve having a neutral position at which the first motor port communicates with the tank port and the inlet port and the second motor port are blocked, the valve spool being moveable in a first direction to communicate the inlet port with the first motor port and a second direction to communicate an inlet port with the second motor port, the valve spool being moved in one of the first and second directions a distance proportional to another control signal received by the control valve.

* * * * *